United States Patent [19]

Shikata et al.

[11] 4,365,603

[45] Dec. 28, 1982

[54] SYSTEM FOR CONTROLLING AIR-FUEL RATIO

[75] Inventors: Makoto Shikata, Musashimurayama; Hisashi Osano, Koganei; Takuro Morozumi, Fuchu, all of Japan

[73] Assignees: Fuji Jukogyo Kabushiki Kaisha, Tokyo; Nissan Motor Co., Ltd., Yokohama, both of Japan

[21] Appl. No.: 174,381

[22] Filed: Aug. 1, 1980

[30] Foreign Application Priority Data

Aug. 2, 1979 [JP] Japan ..... 54-98922

[51] Int. Cl.[3] ..... F02M 7/00

[52] U.S. Cl. ..... 123/440; 123/489; 123/493

[58] Field of Search ..... 123/489, 440, 438, 493

[56] References Cited

U.S. PATENT DOCUMENTS

| | | | |
|---|---|---|---|
| 4,089,313 | 5/1978 | Asano et al. | 123/489 |
| 4,096,834 | 6/1978 | Norimatsu et al. | 123/489 |
| 4,103,649 | 8/1978 | Matumoto et al. | 123/489 |
| 4,121,554 | 10/1978 | Sueishi et al. | 123/440 |
| 4,123,999 | 11/1978 | Asano | 123/489 |
| 4,173,952 | 11/1979 | Asano | 123/489 |
| 4,187,812 | 2/1980 | Hosaka et al. | 123/493 |
| 4,279,230 | 7/1981 | Baur et al. | 123/489 |

FOREIGN PATENT DOCUMENTS

| | | | |
|---|---|---|---|
| 2056712 | 3/1981 | United Kingdom | 123/489 |

*Primary Examiner*—P. S. Lall

*Attorney, Agent, or Firm*—Martin A. Farber

[57] ABSTRACT

A system for controlling air-fuel ratio for a carburetor for an internal combustion engine having an intake passage, on air-fuel mixture supply device, a throttle valve, an exhaust passage, a detector such as an oxygen sensor for detecting the concentration of oxygen in the exhaust gases, an on-off type electromagnetic valve for correcting the air-fuel mixture and an electronic controller.

The electronic controller comprises a comparing circuit for comparing the output signal of the detector with a reference, a proportional and integration circuit for producing a control signal connected to the comparing circuit, a triangular wave pulse generator, and a driving circuit for producing square wave pulses for driving the on-off type electromagnetic valve from the control signals of the proportional and integration circuit and of the triangular wave pulse, generator for controlling the air-fuel ratio to a valve approximately equal to the stoichiometric air-fuel ratio. A holding circuit for memorizing a voltage corresponding to the control signal during an idling operation connectable to the electronic controller. The holding circuit comprises a capacitor for, being charged with the voltage corresponding to control signal and an operational amplifier operated by the voltage charged in the capacitor. A first switch for connecting the capacitor to the electric controller, for charging the capacitor, a second switch for operative connection and disconnection, respectively, of the detector from the electronic controller circuit, and a third switch for connecting during a rapid deceleration that could cause misfiring the output of the amplifier to the electronic controller are provided.

13 Claims, 4 Drawing Figures

SYSTEM FOR CONTROLLING AIR-FUEL RATIO

BACKGROUND OF THE INVENTION

The present invention relates to a system and method for controlling the air-fuel ratio for an internal combustion engine emission control system with a three-way catalyst, and more particularly to a system for controlling the air-fuel ratio to a value approximately equal to the stoichiometric air-fuel ratio so as to effectively operate the three-way catalyst.

Such a system is a feedback control system, in which an oxygen sensor is provided to sense the oxygen content of the exhaust gases to generate an electrical signal as an indication of the air-fuel ratio of the air-fuel mixture supplied by a carburetor. The control system operates to control the air-fuel ratio of the mixture to be supplied to the engine depending upon the signal from the oxygen sensor. However, if misfiring occurs as is experienced during rapid deceleration of the vehicle, a large amount of oxygen remains in the exhaust gases, which is the same condition when a lean mixture is induced and burned in the engine. Accordingly, the oxygen sensor generates a signal indicating a lean mixture, so that the control system operates to vary the mixture to provide a rich air-fuel ratio. Therefore, even if the actually induced mixture is a rich or a proper air-fuel ratio, the mixture is further enriched by the control of the system to an excessively rich air-fuel ratio. Thus, fuel consumption of the engine increases and unburned constituents of the exhaust gases increase.

SUMMARY OF THE INVENTION

An object of the present invention is to provide a system for controlling the air-fuel ratio in which a feedback control system becomes ineffective to the signal from the oxygen sensor upon misfiring and operates to control the air-fuel ratio to a predetermined constant value for preventing an excessively rich mixture supply.

Another object of the present invention is to provide a system which memorizes a pulse duty ratio which actuates an air-fuel ratio control means during a preceding idling operation of the engine and actuates the air-fuel ratio control means at the duty ratio memorized in the preceding idling operation when deceleration subject to misfiring occurs.

According to the present invention, there is provided in a system and method for controlling the air-fuel ratio for a carburetor of an internal combustion engine having an intake passage, air-fuel mixture supply means, for supplying an air-fuel mixture to the intake passage, a throttle valve in the intake passage, an exhaust passage, detecting means for detecting the concentration of a constituent of the exhaust gases passing through the exhaust passage, and electromagnetic valve means for correcting the air-fuel ratio of the air-fuel mixture supplied by said air-fuel mixture supply means, the improvement comprising:

electronic control means comprising a comparing circuit for comparing the output signal of the detecting means with a reference value corresponding to a stoichiometric air-fuel ratio, a proportional and integration circuit connected to the comparing circuit for producing a control signal, driving circuit means operatively connected to the proportional and integration circuit for driving the electromagnetic valve means and for controlling the air-fuel ratio to a value approximately equal to the stoichiometric air-fuel ratio, holding circuit means including a capacitor for selectively charging and memorizing a voltage corresponding to the control signal, and an amplifier being operated by the voltage charged in the capacitor, first switch means when actuated for connecting the capacitor of the holding circuit means to the electronic control means for charging the capacitor, second switch means when actuated for disconnecting the detecting means from the electronic control means, third switch means when actuated for operatively connecting an output of the amplifier of the holding circuit means to the driving circuit means of the electronic control means, means for sensing an idling condition and thereupon for actuating the first switch means, whereby voltage is charged in the capacitor during the idling condition, and a vacuum switch for detecting a high vacuum in the intake passage which occurs in such a rapid deceleration that could cause misfiring to occur and for actuating the second switch means and the third switch means, whereby the driving circuit means is operated by the output of the amplifier for driving the electromagnetic valve means with a control signal substantially equal to the control signal in the preceding idling condition.

Other objects and features of the present invention will become apparent from the following description of a preferred embodiment with reference to the accompanying drawings.

DETAILED DESCRIPTION OF THE PREFERRED EMBODIMENT

Figure 1:
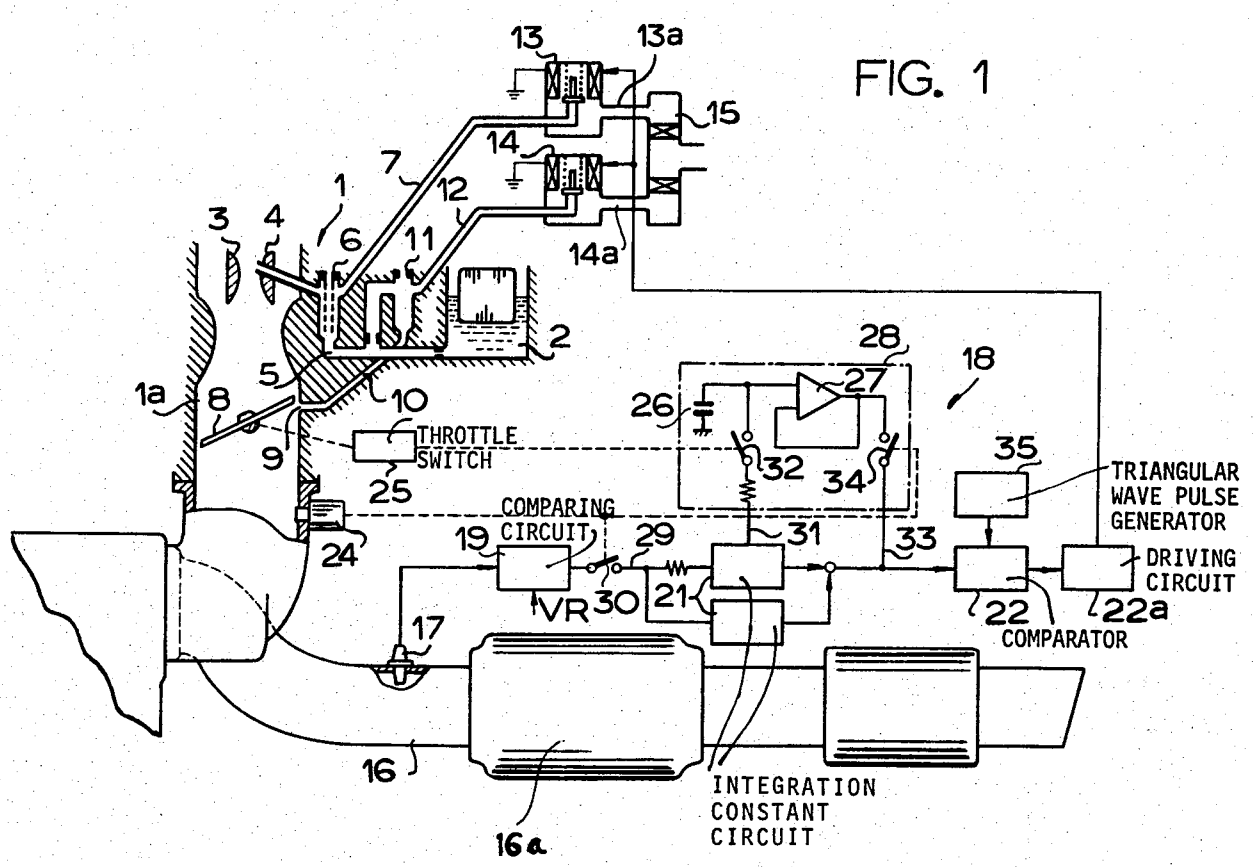
FIG. 1 is a schematic view of a system for controlling the air-fuel ratio according to the present invention.

Referring to FIG. 1, a carburetor 1 communicates with an internal combustion engine (not shown), which comprises a float chamber 2, an induction passage 1*a* in which there are disposed a venturi 3, a nozzle 4 communicating with the float chamber 2 through a main fuel passage 5, and a slow port 9 communicating with the float chamber 2 through a slow fuel passage. A throttle valve 8 is disposed in the induction passage 1*a*. Air correcting passages 7 and 12 are provided in parallel to a main air bleed 6 and a slow air bleed 11, respectively. On-off type electromagnetic valves 13 and 14 are provided for opening and closing the air correcting passages 7 and 12. The inlet ports of 13*a* and 14*a* of each on-off type electromagnetic valve communicates with the atmosphere through an air cleaner or filter 15. An oxygen sensor 17 is disposed in an exhaust pipe 16 for detecting the oxygen content of the exhaust gases from the engine. A three-way catalytic converter 16*a* is disposed in the exhaust pipe 16 downstream of the oxygen sensor 17.

Figure 3:
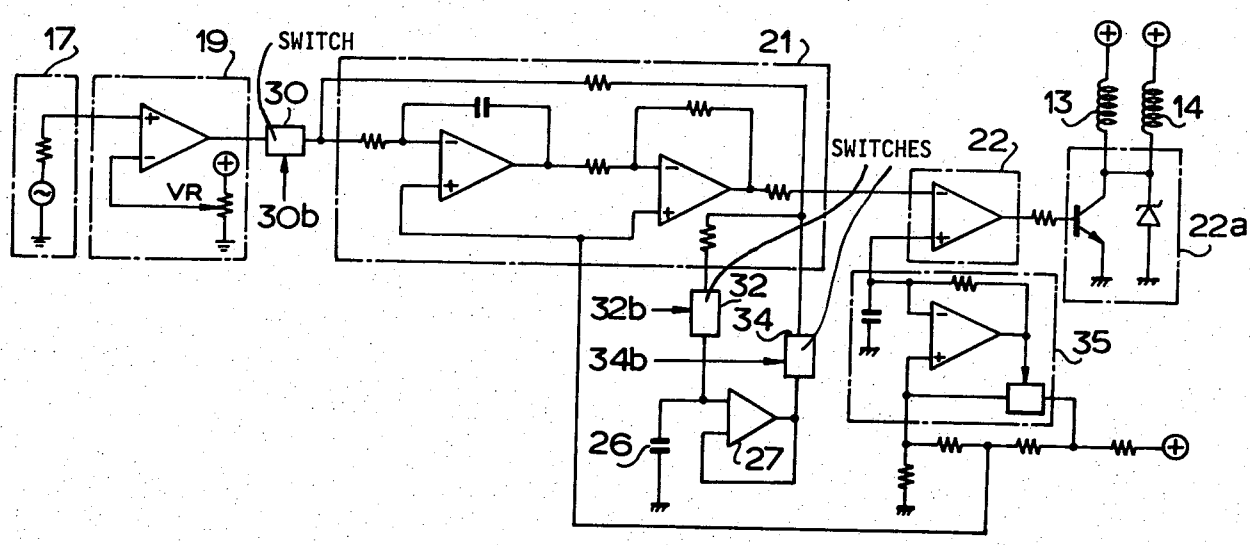
FIG. 3 shows a feedback control circuit used in the system of FIG. 1.

The output signal of the oxygen sensor 17, which is dependent on the oxygen content in the exhaust gases, is applied to a comparing circuit 19 of a feedback control circuit. The comparing circuit 19 operates to compare the output signal of the oxygen sensor 17 with a predetermined reference value $V_R$ (FIG. 3) corresponding to the stoichiometric air-fuel ratio and to discriminate whether the output signal is indicative of a rich or lean mixture compared with the reference stoichiometric ratio to produce an output signal in line 29. The output signal is fed to a proportional constant and integration constant circuit 21 via a normally closed switch 30, where the signal is converted to a control signal which varies in an opposite direction to the direction represented by the output signal of the comparing circuit 19. The control signal is compared in a comparator 22 with triangular wave pulses applied from a triangular wave pulse generator 35 so that square wave pulses are produced in comparator 22 and sent to the driving circuit 22*a* and then to operate the on-off type electromagnetic valves 13 and 14.

When a rich air-fuel ratio is detected in circuit 19, the comparator 22 produces output pulses having a greater pulse duty ratio, whereby the amount of air passing through the on-off electromagnetic valves 13 and 14 increases since the opening times of the valves are increased. Thus, the amount of air in the mixture fed from the carburetor 1 increases to thereby increase the air-fuel ratio. When a lean air-fuel ratio is detected in circuit 19, an output having a smaller duty ratio is produced, whereby the air-fuel ratio is decreased to enrich the mixture.

In accordance with the present invention, a vacuum switch 24 is provided in an intake passage 1*a* downstream of the throttle valve 8 for detecting a high vacuum which would occur in such a rapid deceleration condition that could cause misfiring to occur. A throttle switch 25 is provided to be closed upon occurrence of the idling condition.

A holding circuit 18 having a capacitor 26 and an operational amplifier 27 is connected to the integration constant circuit 21 through lines 31 and 33. A normally open switch 32 (which is closed by an output signal of the throttle switch 25) is provided in the line 31. A normally closed switch 30 (which is opened by an output signal of the vacuum switch 24) is provided in the line 29 connecting the comparing circuit 19 and the integration constant circuit 21, and a normally open switch 34 (which is closed by an output signal of the vacuum sensor 24) is provided in the line 33.

Figure 2:
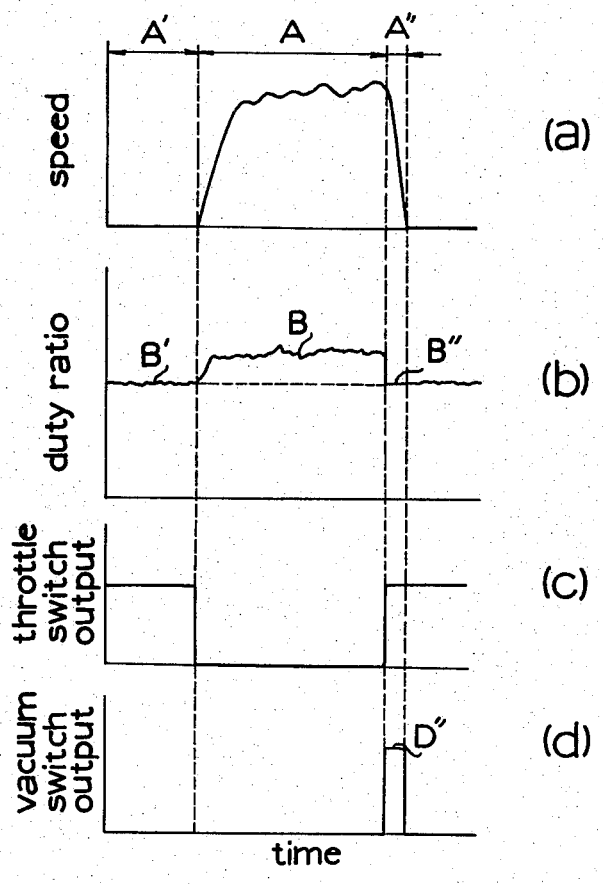
FIGS. 2(*a*)–2(*d*) are graphs showing the operation of the system of FIG. 1.

In a usual or normal driving condition such as the range A in FIG. 2(*a*), the vacuum switch 24 and the throttle switch 25 do not close so that the switch 30 remains closed and the switches 32 and 34 remain opened. Thus, the feedback control system (elements 17, 19, 21, 22, 35, 22*a*, 13, 14) is in an operating effective condition. In this condition output of the driving circuit 22*a* operates to produce output driving pulses, the pulse duty ratio of which varies as shown by B in FIG. 2(*b*) for actuating the on-off type electromagnetic valves 13 and 14. Thus, the air-fuel ratio of the mixture fed from the carburetor 1 is controlled to a proper value approximately equal to the stoichiometric value.

In an idling condition such as the range A′ in FIG. 2(*a*), the control circuit 18 produces output pulses as shown in the range B′ FIG. 2(*b*), thereby controlling the air-fuel ratio to a value approximately equal to the stoichiometric value. In such a condition, the throttle switch 25 closes to produce an output voltage as shown in FIG. 2(*c*) to close the switch 32, so that a voltage corresponding to the control signal during the idling operation is charged in the capacitor 26 via line 31 (elements 17, 19, 21 producing the control signal in line 31). If the vehicle anytime thereafter, even if after a normal driving operation, is sufficiently rapidly decelerated (by an amount which could cause engine misfiring) as shown by the range A″ in FIG. 2, the vacuum switch 24 closes to produce an output signal D″ as shown in FIG. 2(*d*). This output signal D″ opens the switch 30 during this deceleration period and simultaneously closes the switch 34. Thus, the feedback control operation via elements 17, 19, 21 is ineffective and the operational amplifier 27 operates by the voltage previously charged in the capacitor 26 to produce an output via line 33 during the range A″. This output is applied to the comparator 22 and driving circuit 22*a* which produces output pulses having a pulse duty ratio B″ substantially equal to the pulse duty ratio B′ occurring during the preceding idling operation. Thus, the air-fuel ratio is controlled to a value approximately equal to the stoichiometric value. After such a control operation, the capacitor 26 is charged again during the succeeding idling operation.

The vacuum switch 24 is designed such that the output signal therefrom is produced with a delay so that the switching system can not be operated by the operation of the throttle valve 8 and the vacuum in the intake passage 1*a* during the short period of time during shifting gears.

It will be noted that if the throttle switch 25 is constructed so as to produce output signals to actuate all switches 30, 32, 34 with a delay which corresponds to a time when misfiring occurs, the vacuum sensor 24 may be omitted.

Figure 4:
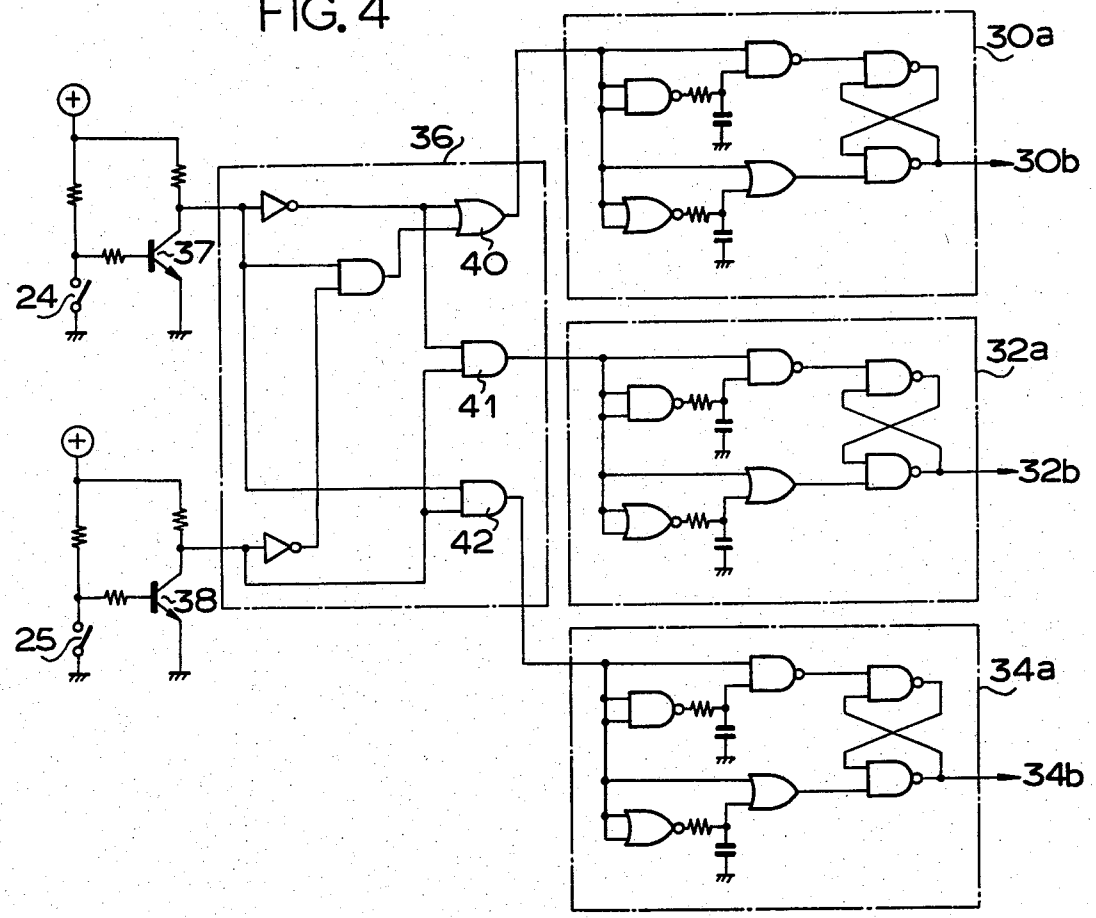
FIG. 4 is a logic circuit for actuating switches in the circuit of FIG. 3.

FIG. 4 shows a logic circuit for actuating switches 30, 32 and 34. The circuit comprises a flip-flop 30*a* for the switch 30, a flip-flop 32*a* for the switch 32, a flip-flop 34*a* for the switch 34, and a control circuit 36. The vacuum switch 24 is connected to the control circuit 36 through a transistor 37 and the throttle switch 25 is connected to the control circuit 36 through a transistor 38. The output 30*b* of the flip-flop 30*a* is connected to the gate of the switch 30, the output 32*b* of the flip-flop 32*a* is connected to the gate of the switch 32 and the output 34*b* of the flip-flop 34*a* is connected to the gate of the switch 34.

In a normal driving condition, the vacuum switch 24 and throttle switch 25 open. Accordingly, the output of the transistor 37 is a 0 level and the output of the transistor 38 is also a 0 level, so that the output of an OR gate 40 is a 1 level, outputs of AND gates 41 and 42 are 0. Consequently, the output 30*b* of the flip-flop 30*a* is 1 and other outputs 32*b* and 34*b* are 0 levels. If the vacuum switch 24 is closed, the output of the OR gate 40 remains unchanged. Therefore, the feedback control operation is not changed.

When the throttle switch 25 is closed in the idling operation, the output 32*b* goes to a 1, so that the switch 32 is closed. Thus, the capacitor 26 is charged with the output voltage of the circuit 21. Further, if the vacuum switch 24 is closed, the output 30*b* goes to a 0 and the output 34*b* goes to a 1. Thus, the switch 30 is opened and the switch 34 is closed, so that the feedback control becomes ineffective and the system is actuated by the output of the holding circuit 18.

In accordance with the present invention, since the feedback control via elements 17, 19, 30, 21 is ineffective during such a rapid deceleration condition where misfiring could occur, it is possible to prevent supply of an excessively enriched air-fuel mixture caused by the detected signal from the oxygen sensor 17. Further, since the air-fuel ratio in the rapid deceleration condition is selected so as to be a value substantially equal to the value in a preceding idling operation, the air-fuel ratio may be controlled to a value approximately equal to the stoichiometric value in spite of a variation of air-fuel ratio setting of the carburetor, whereby the three-way catalytic converter can effectively operate to reduce the harmful constituents of the exhaust gases.

What is claimed is:

1. In a system for controlling the air-fuel ratio for a carburetor of an internal combustion engine having an intake passage, an exhaust passage, a throttle valve in the intake passage, detecting means for detecting the concentration of a constituent of the exhaust gases passing through said exhaust passage, air-fuel mixture supply means for supplying an air-fuel mixture to the intake passage, and an electromagnetic valve means for correcting the air-fuel ratio of the air-fuel mixture supplied by said air-fuel mixture supply means, the improvement comprising:

electronic control means comprising, a comparing circuit means for comparing an output signal of said detecting means with a reference value corresponding to stoichiometric air-fuel ratio, a proportional and integration circuit connected to said comparing circuit means for producing a control signal, and driving circuit means for driving said electromagnetic valve means via said control signal for controlling the air-fuel ratio to a value approximately equal to the stoichiometric air-fuel ratio, holding circuit means including a capacitor means for being charged by and memorizing a voltage corresponding to said control signal and an amplifier means for being operated by the voltage charged in said capacitor, first switch means when actuated for connecting said capacitor means of said holding circuit means to said electronic control means and to said control signal, second switch means when actuated for disconnecting said detecting means operatively from said electronic control means, third switch means when actuated for operatively connecting an output of said amplifier means of said holding circuit means to said driving circuit means of said electronic control means, means for sensing the idling condition and thereupon for actuating said first switch means, whereby said voltage corresponding to said control signal is charged in said capacitor means during the idling condition, and vacuum switch means for detecting a high vacuum in said intake passage which occurs in such a rapid deceleration that could cause misfiring to occur and for thereupon actuating said second switch means and said third switch means, so that during said rapid deceleration said driving circuit means is operated by the output of said amplifier means for operatively driving said electromagnetic valve means with a control signal substantially equal to said control signal in the preceding idling condition.

2. The system for controlling the air-fuel ratio defined in claim 1 wherein said second switch means is a normally closed switch, and said first and third switch means are normally open switches.

3. The system as set forth in claim 1, further comprising a logic circuit operatively connected to said sensing means and said vacuum switch means and to said first, second and third switch means, said logic circuit including logic control circuit means for operating said first, second and third switch means, respectively, dependent on conditions of said sensing means and said vacuum switch means, said sensing means and said vacuum switch means for actuating said first, second and third switch means via said logic control circuit means, said logic control circuit means in cooperation with respective conditions of said vacuum switch means and said sensing means for closing said second switch means thereby connecting said detecting means operatively to said electronic control means and for opening said third switch means thereby disconnecting said amplifier means from said driving circuit means when said first switch means is actuated.

4. The system as set forth in claim 3, wherein said logic control circuit means in cooperation with respective conditions of said vacuum switch means for opening said first and third switch means and for closing said second switch means during normal driving condition of the engine.

5. The system as set forth in claim 4, wherein said vacuum switch means and said sensing means are for being in an open condition during said normal driving condition of the engine.

6. The system as set forth in claim 3 or 5, wherein said vacuum switch means is in an open condition and said sensing means is in a closed condition in said idling condition.

7. The system as set forth in claim 4 or 5, wherein said logic control circuit means in cooperation with respective conditions of said vacuum switch means for maintaining the conditions of said first, second and third switch means even if the condition of said vacuum switch means only is changed from that condition of said vacuum switch means when it is in said normal driving condition of the engine.

8. The system as set forth in claim 1 or 5, wherein said vacuum switch means is for charging conditions with delay during a shifting of gears.

9. The system as set forth in claim 1 or 5, wherein said vacuum switch means and said sensing means are for being in a closed condition in the condition of said rapid deceleration.

10. The system as set forth in claim 9, wherein said logic control circuit means in cooperation with respective conditions of said vacuum switch means for opening said first switch means in the condition of said rapid deceleration.

11. The system as set forth in claim 1, wherein said sensing means constitutes means for detecting the position of said throttle.

12. The system as set forth in claim 11, wherein said sensing means is opened when said throttle valve is opened in a normal driving condition of the engine and is closed in the idling condition.

13. The system as set forth in claim 1, wherein said sensing means is for closing at latest at commencement of said rapid deceleration during a change in condition of the throttle valve from an open condition of the throttle valve to a closing condition thereof.

* * * * *

UNITED STATES PATENT AND TRADEMARK OFFICE

CERTIFICATE OF CORRECTION

PATENT NO. : 4,365,603

DATED : December 28, 1982

INVENTOR(S) : Makoto Shikata et al

It is certified that error appears in the above-identified patent and that said Letters Patent are hereby corrected as shown below:

Column 5, Line 31 (claim 1) "means via" should read

--means and via--

Signed and Sealed this

*Twenty-ninth* Day of *March 1983*

[SEAL]

*Attest:*

GERALD J. MOSSINGHOFF

*Attesting Officer*

*Commissioner of Patents and Trademarks*